US009881763B2

(12) United States Patent
Ujimoto

(10) Patent No.: US 9,881,763 B2
(45) Date of Patent: Jan. 30, 2018

(54) ION GENERATION DEVICE AND ION DETECTION DEVICE

(71) Applicant: Katsuya Ujimoto, Hyogo (JP)

(72) Inventor: Katsuya Ujimoto, Hyogo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/348,034

(22) Filed: Nov. 10, 2016

(65) Prior Publication Data

US 2017/0133190 A1 May 11, 2017

(30) Foreign Application Priority Data

Nov. 11, 2015 (JP) ..... 2015-221046
Aug. 26, 2016 (JP) ..... 2016-165265

(51) Int. Cl.
*H01J 27/26* (2006.01)
*H01J 1/15* (2006.01)
*H01J 1/13* (2006.01)

(52) U.S. Cl.
CPC ..... *H01J 27/26* (2013.01); *H01J 1/13* (2013.01); *H01J 1/15* (2013.01)

(58) Field of Classification Search
CPC ..... H01J 1/13; H01J 1/135; H01J 1/15
See application file for complete search history.

(56) References Cited

U.S. PATENT DOCUMENTS

2008/0251735 A1 10/2008 Putterman et al.
2010/0148051 A1 6/2010 Hart et al.
2011/0072887 A1* 3/2011 Oki ..... B03C 3/014 73/28.02
2013/0277567 A1 10/2013 Dardona et al.
2014/0204975 A1* 7/2014 Kosakai ..... H01L 21/67248 374/179
2015/0028196 A1 1/2015 Toutoungi et al.

FOREIGN PATENT DOCUMENTS

| | | |
|---|---|---|
| GB | 2330456 A | 4/1999 |
| JP | 11-195386 | 7/1999 |
| JP | 2004-241162 | 8/2004 |
| WO | WO 2004/048964 A1 | 6/2004 |

OTHER PUBLICATIONS

European search report dated Mar. 9, 2017 in corresponding European Patent Application No. 16196914.2.
Evan L. Neidholdt and J. L. Beauchamp, "Ionization Mechanism of the Ambient Pressure Pyroelectric Ion Source (APPIS) and Its Applications to Chemical Nerve Agent Detection", Journal of the American Society for Mass Spectrometry, 2009, 20, pp. 2093-2099.

* cited by examiner

*Primary Examiner* — Kenneth J Malkowski
(74) *Attorney, Agent, or Firm* — Cooper & Dunham LLP

(57) ABSTRACT

An ion generation device is provided, which includes: a heater; a counter electrode arranged on one side of the heater; at least one electric member arranged between the heater and the counter electrode, the electric member being made of a pyroelectric element or a piezoelectric element; an electrode arranged between the heater and the electric member to be in contact with the electric member; and a temperature control circuit to control a temperature of the heater. An ion detection device is provided, which includes the above-described ion generation device, an ion filter to sort ions generated at the ion generation device, and a detector to detect the ions sorted in the ion filter.

18 Claims, 15 Drawing Sheets

(a)

(b)

ION GENERATION DEVICE AND ION DETECTION DEVICE

CROSS-REFERENCE TO RELATED APPLICATIONS

This patent application is based on and claims priority pursuant to 35 U.S.C. §119(a) to Japanese Patent Application Nos. 2015-221046, filed on Nov. 11, 2015, and 2016-165265, filed on Aug. 26, 2016, in the Japan Patent Office, the entire disclosure of which is hereby incorporated by reference herein.

BACKGROUND

Technical Field

The present invention relates to an ion generation device and an ion detection device.

Description of the Related Art

As a method of ionizing a gas, use of pyroelectric effect is already known. Pyroelectric material is material in which a surface potential is changed according to temperature change, and can ionize the gas with a generated voltage.

Further, a technology by which downsizing, reduction of power consumption, and high-speed response can be expected, by forming a pyroelectric thin film on a heater with small heat capacity, is known (for example, JP-2004-241162-A).

In more details, JP-2004-241162-A provides a charge emitter that enables discharge of charges such as electrons and ions with a small applied voltage such as about several volts, and a display device using the charge emitter. A pyroelectric element is heated by the heater with small heat capacity in vacuo, and adsorption floating charges based on change of a spontaneous polarization amount changed by heating are discharged from an electrode. The disclosed charge emitter enables display of a full-color image by using light emission of a fluorescent body due to collisions of emitted charges using the charge emitter, by using a light emission color by discharging a gas with the emitted charges, or by using light emission by stimulating the fluorescent body with radiating ultraviolet rays or the like.

However, in the conventional technology using the pyroelectric effect such as JP-2004-241162-A, temperature control for controlling the generated voltage, which may affect an ion production amount, has not been performed, causing the production amount of the ions be unstable.

SUMMARY

Example embodiments of the present invention include an ion generation device including: a heater; a counter electrode arranged on one side of the heater, at least one electric member arranged between the heater and the counter electrode, the electric member being made of a pyroelectric element or a piezoelectric element; an electrode arranged between the heater and the electric member to be in contact with the electric member; and a temperature control circuit to control a temperature of the heater.

Example embodiments of the present invention include an ion detection device including the above-described ion generation device, an ion filter to sort ions generated at the ion generation device, and a detector to detect the ions sorted in the ion filter.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
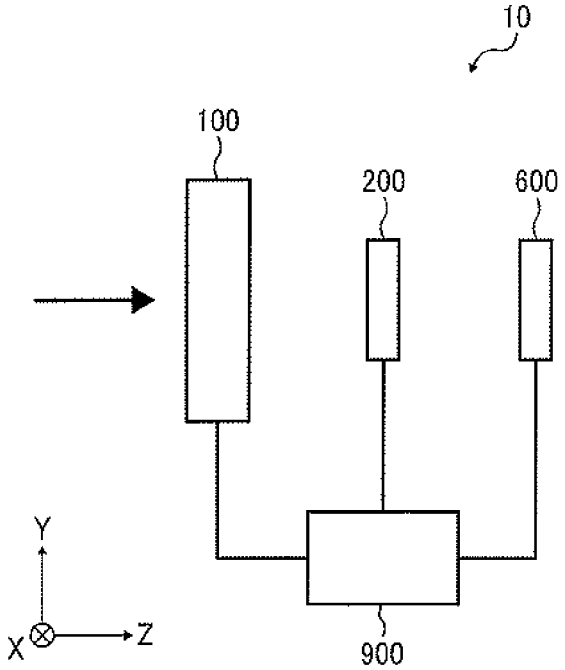
FIG. 1 is a schematic configuration diagram of an ion detection device according to an embodiment.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF THE INVENTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Hereinafter, embodiments of the present invention will be described on the basis of the drawings. FIG. 1 illustrates a schematic configuration of an ion detection device 10 according to an embodiment.

The ion detection device 10 includes an ion generator 100, an ion filter 200, a detector 600, a controller 900, and the like. Note that, here, an XYZ three-dimensional orthogonal coordinate system is used, and a traveling direction of molecules to be measured is a +Z direction.

The ion generator 100 ionizes the molecules to be measured. The ion filter 200 sorts the ions generated at the ion generator 100. The detector 600 detects the ions sorted by the ion filter 200. The controller 900 controls the entire device.

A basic principle of the ion detection device 10 will be described.

The ion filter 200 includes two electrodes (an electrode A and an electrode B) arranged to face each other.

An ion moves at a moving speed V expressed by the following formula (1) under an environment of an electric field E:

$$V=K\times E \tag{1}$$

Here, K represents mobility of the ion.

Figure 2:
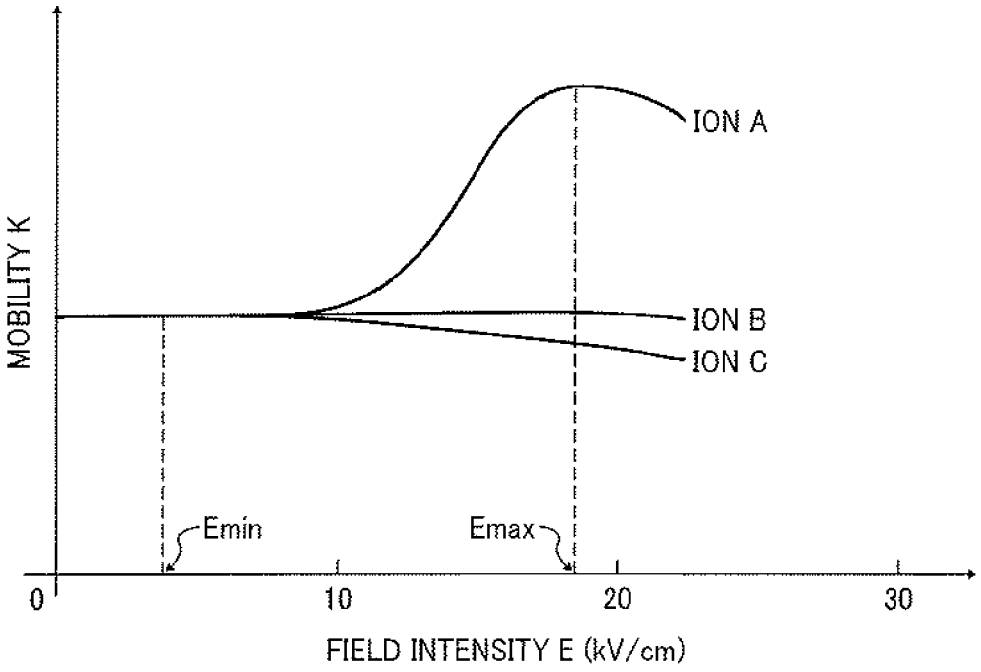
FIG. 2 is a diagram for describing field intensity dependency of mobility of ions according to the embodiment.

The mobility of an ion has field intensity dependency. Further, the field intensity dependency differs depending on a type of the ion. FIG. 2 illustrates the field intensity dependency of the mobility in three ions (an ion A, an ion B, and an ion C) of different types, as an example. Note that, in FIG. 2, the mobility of the ions is normalized to become equal in field intensity 0, for easy understanding.

The mobility of the three ions (the ion A, the ion B, and the ion C) is nearly unchanged in low field intensity where the field intensity is 9 kV/cm or less. Characteristics specific to the types of the ions appear as the field intensity is increased from about 10 kV/cm. The mobility of the ion A is increased in a large manner as the field intensity is increased, and is maximized at Emax. The mobility of the ion B is increased more gently than the ion A. The mobility of the ion C is gently decreased. As described above, the ions A, B, and C exhibit the three different characteristics. The ion filter 200 sorts the ions using the difference between the mobility in the low field intensity and the mobility in the high field intensity.

Figure 3:
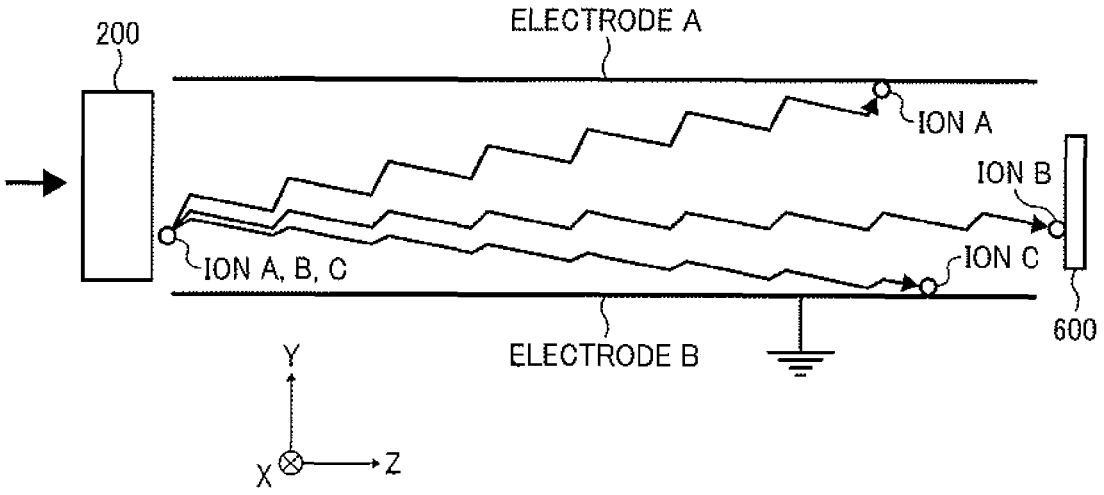
FIG. 3 is a diagram for describing trajectories of movement of three ions (an ion A, an ion B, and an ion C) between electrodes of an ion filter according to the embodiment.

FIG. 3 illustrates trajectories of movement of the three ions (the ion A, the ion B, and the ion C) between the electrodes of the ion filter 200. Note that, here, for simplicity, the electrode A and the electrode B are assumed to be parallel flat plates made of conductors.

By causing a waveform of the electric field generated between the electrode A and the electrode B to be an asymmetric electric field waveform, only an arbitrary ion (the ion B in FIG. 3) can be caused to reach the detector 600.

Figure 4:
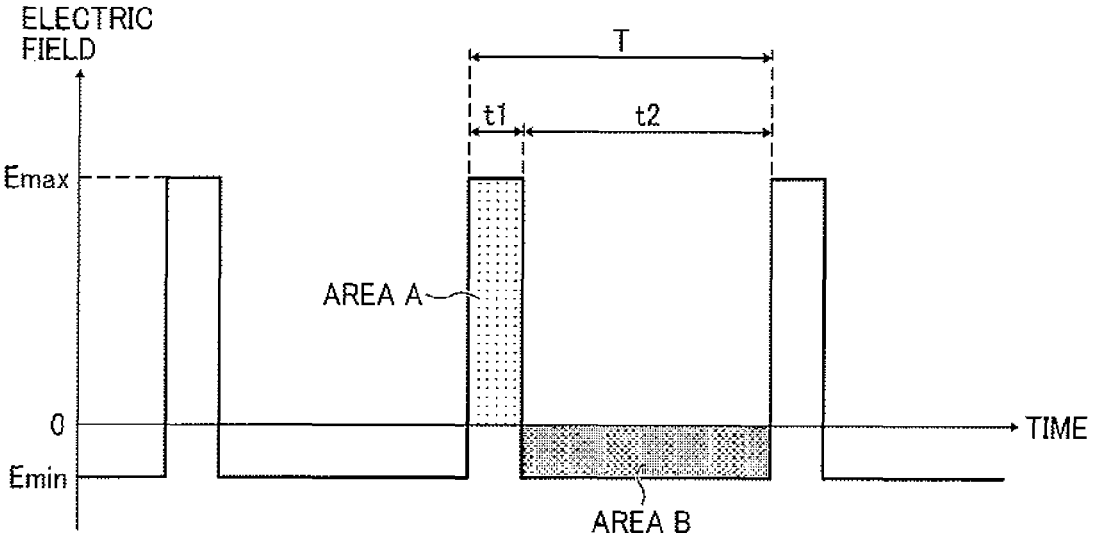
FIG. 4 is a diagram for describing an electric field waveform generated between an electrode A and an electrode B according to the embodiment.

FIG. 4 illustrates an example of the electric field waveform generated between the electrode A and the electrode B. This electric field waveform alternately repeats a positive high electric field (Emax) and a negative low electric field (Emin). Further, a term (t1) of the high electric field is shorter than a term (t2) of the low electric field, and a ratio of the t1 and the t2 is from 1:3 to 1:5. As described above, the electric field waveform is asymmetric with respect to the up and down. The asymmetric electric field waveform has a time average electric field of 0, and is set to establish the following formula (2):

$$|E\mathrm{max}|\times t1=|E\mathrm{min}|\times t2 \tag{2}$$

That is, the electric field waveform is set such that the area of the area A and the area of the area B in FIG. 4 are matched.

Note that, hereinafter, the value of |Emax|×t1 and the value of |Emin|×t2 are 13, as expressed by the following formula (3):

$$|E\mathrm{max}|\times t1=|E\mathrm{min}|\times t2=\beta \tag{3}$$

In the term (t1) of the high electric field, a speed Vup at which the ion moves in a Y-axis direction is expressed by the following formula (4):

$$V\mathrm{up}=K(E\mathrm{max})\times|E\mathrm{max}| \tag{4}$$

Here, K (Emax) is the mobility of the ion in the case of the high electric field (Emax).

Figure 5:
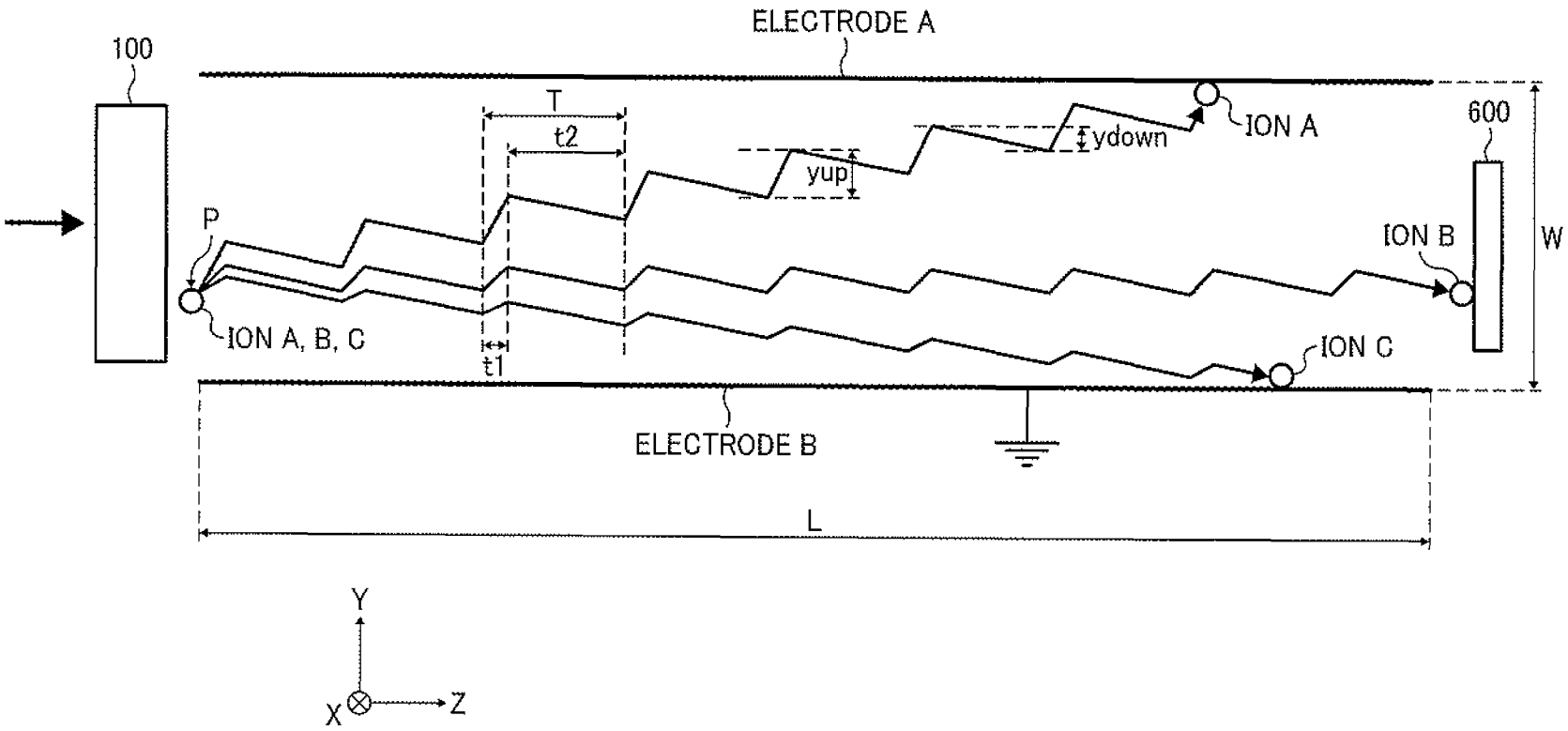
FIG. 5 is a diagram for describing trajectories of movement of three ions (an ion A, an ion B, and an ion C) between electrodes of an ion filter according to the embodiment.

For example, in a case where |Emax| is about 10 kV/cm or more, the mobility differs in each of the ions among the three ions (the ion A, the ion B, and the ion C) (see FIG. 2). Therefore, the three ions have three different moving speeds Vup. That is, as illustrated in FIG. 5, in the term (t1) of the high electric field, inclinations of the moving trajectories of the three ions differ from one another. In FIG. 5, the point "P" indicates an initial position of the ion.

Further, displacement yup (see FIG. 5) that is a distance by which the ion moves in the Y-axis direction in the term (t1) of the high electric field is expressed by the following formula (5):

$$y\mathrm{up}=V\mathrm{up}\times t1 \tag{5}$$

Meanwhile, a speed Vdown at which the ion moves in the Y-axis direction in the term (t2) of the low electric field is expressed by the following formula (6):

$$V\mathrm{down}=-K(E\mathrm{min})\times|E\mathrm{min}| \tag{6}$$

Here, K (Emin) is the mobility of the ion in the case of the low electric field (Emin).

For example, in a case where |Emin| is about 5 kV/cm or less, the mobility is nearly the same among the three ions (the ion A, the ion B, and the ion C) (see FIG. 2). Therefore, the moving speeds Vdown of the three ions are nearly the same. That is, as illustrated in FIG. 5, in the term (t2) of the low electric field, the inclinations of the moving trajectories of the three ions are nearly the same.

Further, displacement ydown (see FIG. 5) that is a distance by which the ion moves in the Y-axis direction in the term (t2) of the low electric field is expressed by the following formula (7):

$$y\mathrm{down}=V\mathrm{down}\times t2 \tag{7}$$

Within one cycle (T) of the asymmetric electric field waveform, the ion moves in a +Y direction during the term t1 and moves in a −Y direction during the term t2 while moving in a +Z direction.

Therefore, as illustrated in FIG. 5, the ions are divided into the ion (ion A) moving toward the electrode A while repeating zigzag movement, the ion (ion C) moving toward the electrode B while repeating zigzag movement, and the ion (ion B) moving toward the detector 600 while the displacement in the +Y direction and the displacement in the −Y direction are balanced.

In one period (T) in the asymmetric electric field waveform, average displacement ΔyRF in the Y-axis direction of the ion is expressed by the following formula (8):

$$\Delta yRF = y\text{up} + y\text{down} = K(E\text{max}) \times |E\text{max}| \times t1 - K(E\text{min}) \times |E\text{min}| \times t2 \quad (8)$$

Further, the above formula (8) can be expressed by the following formula (9) using the above-described formula (3):

$$\Delta yRF = \beta\{K(E\text{max}) - K(\text{min})\} \quad (9)$$

The above-described formula (9) is expressed by the following formula (10):

$$\Delta yRF = \beta\Delta K \quad (10)$$

Here, K(Emax)−K(min) is ΔK.

β is a constant determined by the asymmetric electric field applied between the electrode A and the electrode B. Therefore, the displacement of the ion in the Y-axis direction per one cycle (T) of the asymmetric electric field waveform depends on ΔK that is a difference between the mobility in the low electric field (Emin) and the mobility in the high electric field (Emax).

Assume that only a carrier gas transfers the ion in the Z-axis direction, and the displacement Y of the ion in the Y-axis direction when the ion stays between the electrode A and the electrode B is expressed by the following formula (11):

[Mathematical Formula 11]

$$Y = \frac{\Delta yRF}{(t1 + t2)} \times tres = \frac{\beta\Delta K}{T} \times tres \quad (11)$$

Here, tres is an average time during which the ion stays between the electrode A and the electrode B (average ion stay time).

The average ion stay time tres can be expressed by the following formula (12):

[Mathematical Formula 12]

$$tres = \frac{AL}{Q} = \frac{V}{Q} \quad (12)$$

Here, A is a section area of the ion filter, L is the length of the electrode in the Z-axis direction (electrode length) (see FIG. 5), Q is a volume flow rate of the carrier gas. V is the volume of the ion filter (=AL).

The above-described formula (11) can be expressed by the following formula (13) using the above-described formula (12) and the above-described formula (13):

[Mathematical Formula 13]

$$Y = \frac{\Delta K \times E\text{max} \times V \times D}{Q} \quad (13)$$

Here, D is a duty of the asymmetric electric field waveform and D=t1/T.

It can be seen that the displacement Y is proportional to the difference ΔK between the mobility in the low electric field (Emin) and the mobility in the high electric field (Emax) specific to the ion type, from the above-described formula (13), if the same values are used for the high electric field Emax in the asymmetric electric field waveform, the volume V of the ion filter, the duty D of the asymmetric electric field waveform, and the volume flow rate Q of the carrier gas, for all of the ion types.

Note that, in FIG. 5, only the ion B has the minimum displacement Y and can reach the detector 600. However, by changing the duty D, the ion having a different ΔK from the ion B can reach the detector 600. Further, by changing the duty D bit by bit, existence/non-existence or the amount of various ions having a different ΔK can be detected.

Further, as a method of detecting various ion types having a different ΔK in the ion detection device 10, there is a method of superimposing a DC electric field with low intensity on the asymmetric electric field waveform. According to this method, displacement amounts in the Y-axis direction in the terms t1 and t2 can be changed. Therefore, the ion types that can reach the detector 600 without coming in contact with the electrode A or the electrode B can be continuously changed. Note that the DC electric field to be superimposed on the asymmetric electric field waveform is called compensation voltage (CV). In this method, the existence/non-existence and the amount of the various ion types having a different ΔK are detected by sweeping the compensation voltage.

The ion coming in contact with the electrode A or the electrode B before reaching the detector 600 is neutralized and becomes a non-ion, and cannot be detected.

Note that the controller 900 is similar to a general-purpose computer that is usually provided in any desired ion detection device, and thus here, detailed description about the operation of the controller 900 is omitted.

Figure 6:
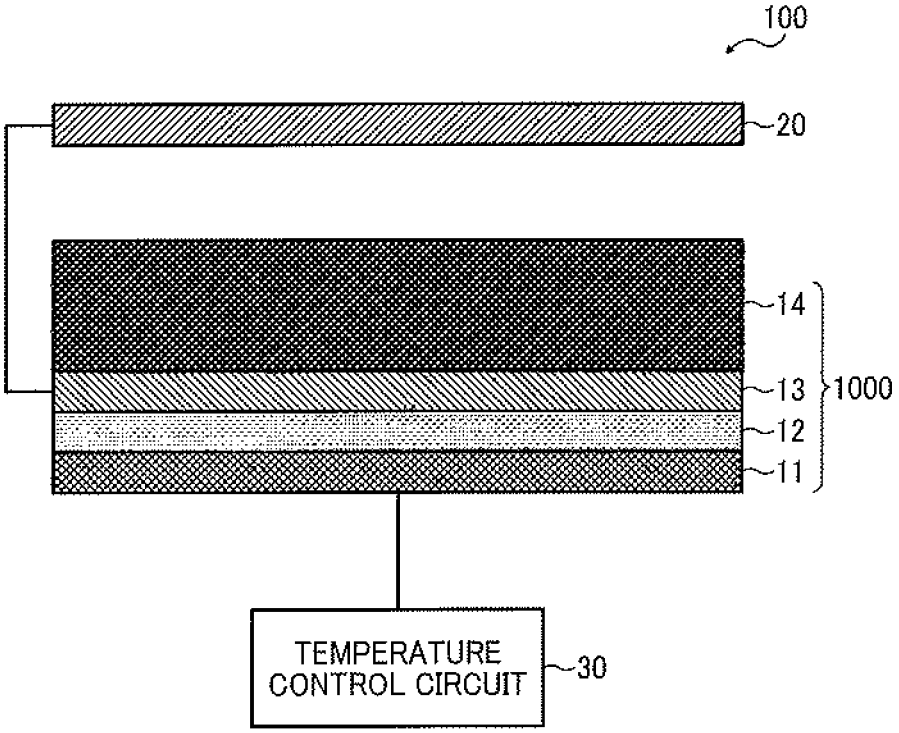
FIG. 6 is a diagram illustrating a schematic configuration of an ion generator according to the embodiment.
Figure 7A:
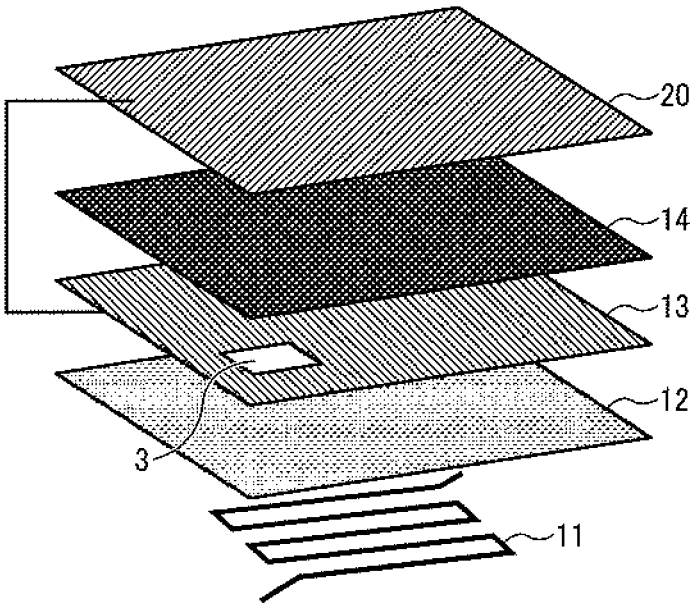
FIG. 7A is an exploded perspective view of the ion generator (excluding a temperature control circuit) according to the embodiment.
Figure 7B:
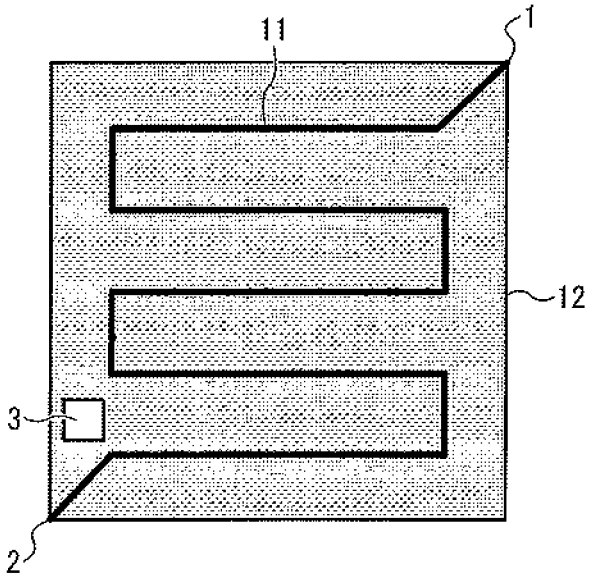
FIG. 7B is a plan view of a heater according to the embodiment.

Hereinafter, the ion generator 100 will be described in detail. FIG. 6 illustrates a schematic configuration of the ion generator 100 in a sectional view. FIG. 7A illustrates an exploded perspective view of the ion generator 100 (excluding a portion). FIG. 7B illustrates a plan view of a heater included in the ion generator 100.

As illustrated in FIGS. 6 and 7A, the ion generator 100 includes a laminated body 1000 in which a heater 11 as a heater, an insulating film 12, an electrode 13, and a pyroelectric element film 14 are laminated in this order, and a counter electrode 20 facing the pyroelectric element film 14. Here, the electrode 13 and the counter electrode 20 are formed as a thin film.

That is, the laminated body 1000 and the counter electrode 20 are arranged side by side in a laminating direction of the laminated body 1000 such that the pyroelectric element film 14 and the counter electrode 20 face each other.

The heater 11 is a microelectromechanical system (MEMS) micro heater (heater with small heat capacity) formed of a metal wire or an alloy wire, and generates heat by Joule's heat. Here, the heater 11 is formed of a winding metal wire or alloy wire, and a current flows in from one end portion 1 and the current flows out from the other end portion 2 (see FIG. 7B). As illustrated in FIGS. 7A and 7B, the electrode 13 has a contact hole 3 through which wiring provided in the electrode 13 is pulled out. As material for the heater 11, material with identified temperature dependency of electric resistance is suitable, and an example includes, Pt.

As the pyroelectric element as the material of the pyroelectric element film 14, any pyroelectric element can be employed as long as it exhibits pyroelectric effect, and examples include, for example, lithium niobate ($LiNbO_3$), barium titanate ($BaTO_3$), lithium tantalate ($LiTaO_3$), lead zirconate titanate (PZT), rochelle salt ($KNaC_4H_4O_6$), cesium nitrate ($CsNO_3$), tourmaline, and hemimorphite ($Zn_4Si_2O_7(OH)_2.H_2O$).

As the insulating film 12, one having good insulation properties and a thermal expansion coefficient close to other members (the heater 11 and the electrode 13) is favorable.

The pyroelectric effect is caused in the pyroelectric element film 14 by the heat generation of the heater 11. That is, a potential difference (voltage) is caused between a surface (a plane on the counter electrode 20 side) and a back surface (a plane on the electrode 13 side) of the pyroelectric element film 14 by temperature change of the pyroelectric element film 14 (before and after the heat generation) by the heat generation of the heater 11. This potential difference is proportional to the temperature change of the pyroelectric element film 14, as can be seen from the formula (11) described below.

The electrode 13 and the counter electrode 20 are connected by wiring, and have an approximately equal potential. As the material for the electrode and the counter electrode, for example, tungsten having less deterioration due to sputtering caused by discharge is favorable.

Therefore, an electric field E obtained by dividing the voltage caused by the pyroelectric effect by an interval between the electrode 13 and the counter electrode 20 is caused between the electrode 13 and the counter electrode 20.

By causing intensity of the electric field E to be near an insulation breakdown electric field of a gas, the gas can be discharged between the laminated body 1000 and the counter electrode 20, and the gas can be ionized. That is, the ions can be produced.

Here, when the temperature of the heater 11 is changed by change of the environmental temperature and humidity, for example, a temperature change amount of the pyroelectric element film 14 varies and the voltage caused in the pyroelectric element film 14 is changed, and the intensity of the electric field E caused between the electrode 13 and the counter electrode 20 is changed. As a result, an ion production amount (ion generation amount) varies. That is, the ions cannot be stably produced.

To put it the other way round, the intensity of the electric field E can be adjusted by controlling the temperature of the heater 11 and controlling the temperature change of the pyroelectric element film 14, that is, by controlling the magnitude of the voltage caused in the pyroelectric element film 14. Accordingly, the ion production amount can be made constant (to a desired value). That is, the ions can be stably produced.

By the way, usually, production of a voltage in the kV order requires a large booster circuit. However, by using the temperature dependency (pyroelectric effect) of spontaneous polarization that is electrostatic energy spontaneously held by the pyroelectric element material itself, the voltage in the kV order can be produced for the small pyroelectric element with small input energy.

An electromotive voltage ΔV by the pyroelectric effect can be expressed by the following formula (1A):

$$\Delta V = d \times \varphi \times \Delta T / \epsilon \quad (1A)$$

In the above formula (1A), d denotes the thickness of the pyroelectric material, φ denotes a pyroelectric coefficient, ΔT denotes the temperature change, and a denotes permittivity of the pyroelectric material.

In the ion generator 100 of the present embodiment, by forming the pyroelectric element material near one side of the MEMS micro heater, the heat capacity can be made small. Therefore, the temperature can be controlled at a higher speed than a case of using a conventional single crystal, that is, the voltage can be controlled at a higher speed. As a result, the gas can be ionized at a high speed. That is, high-speed response can be realized.

At this time, by accurately controlling the temperature change of the pyroelectric element material regardless of the environmental temperature and humidity, the generated voltage can be controlled, and as a result, the ion production amount can be controlled.

Typically, the pyroelectric coefficient and the permittivity of the pyroelectric element material have temperature dependency. Therefore, by controlling the temperature suitable for the material to be used by the above formula (1A), the generated voltage can be controlled.

As a result, to stably produce the ions using the pyroelectric element, the temperature of the heat-generating body (heater) that induces the temperature change of the pyroelectric element needs to be controlled to be constant regardless of the environmental temperature and humidity.

Therefore, the ion generator 100 of the present embodiment further includes a temperature control circuit 30 by which the temperature of the heater 11 is controlled. That is, the temperature of the heater 11 is controlled by the temperature control circuit 30.

Hereinafter, a mechanism of the temperature control by the temperature control circuit 30 will be described.

The temperature of the heater 11 is determined according to a heat generation amount of the heater 11, which is changed depending on the current to be applied or the environmental temperature and humidity.

$H=I^2Rt$ is established, where the heat generation amount of the heater 11 is H, a current to be applied is I, the electric resistance (resistance value) is R, and an applied time of the current I is t. Further, $H/t=I^2R=P$ (power).

That is, the heat generation amount H of the heater 11 depends on the current I, the electric resistance R, and the applied time t.

Further, the electric resistance R has temperature dependency. That is, when the temperature rises, the electric resistance R rises.

Further, the relationship of $V=IR$ is established among the voltage V, the electric resistance R, and the current I caused in the heater 11.

As a result, the temperature of the heater 11 is determined by the voltage V and the current I under a condition where the applied time t of the current I is the same.

Therefore, the temperature control circuit 30 controls the temperature of the heater 11 to a set temperature (target value) by adjusting an input current to the heater 11 such that the voltage V caused in the heater 11 and the voltage caused in a reference resistance circuit 33 (see FIG. 8, simply called "reference resistance") become equal, as described in detail below.

As a result, the heater 11 can be controlled to the set temperature regardless of the change of the environmental temperature and humidity.

Figure 8:
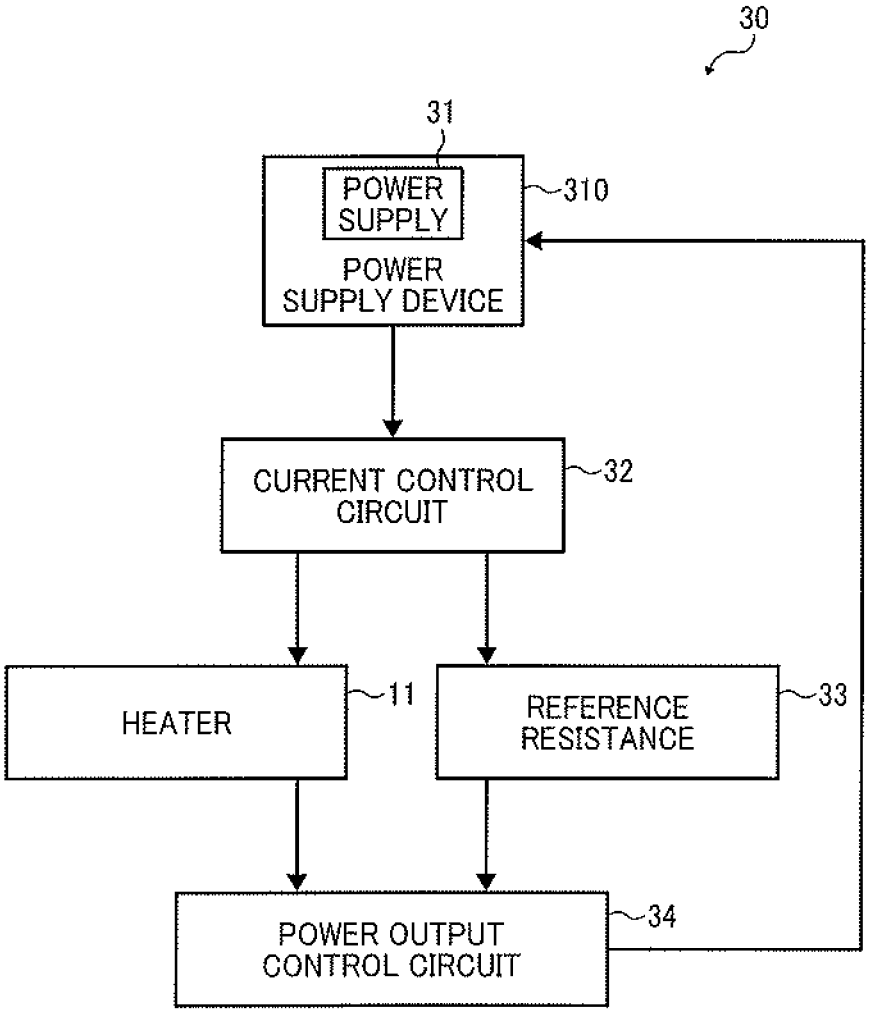
FIG. 8 is a block diagram illustrating a hardware configuration of a temperature control circuit according to the embodiment.

As illustrated in FIG. 8, the temperature control circuit 30 includes a power supply device 310 including a power supply 31, a current control circuit 32, the reference resistance 33, a power output control circuit 34, and the like.

The current control circuit 32 is connected between the power supply device 310, and the heater 11 and the reference resistance 33, and makes a ratio of currents flowing to the heater 11 and to the reference resistance 33 constant. For example, the current flowing into the heater 11 can be made N times (for example, ten times) the current flowing into the reference resistance 33. Note that N≥1 is favorable.

Further, the electric resistance of the reference resistance 33 is variable. The voltage caused in the reference resistance 33 is determined by the electric resistance of the reference resistance 33 and a current to be applied. Here, the current to be applied to the reference resistance 33 is small not to cause the heat generation. That is, temperature change of the reference resistance 33 is nearly 0, and the temperature change of the resistance value is little.

The power output control circuit 34 controls an output of the power supply 31 such that the voltage caused in the heater 11 and the voltage caused in the reference resistance 33 become approximately the same.

The following formulas (2A) and (3A) are established:

$$V_H = R_H \times N \times i \quad (2A)$$

$$V_{ref} = R_{ref} \times i \quad (3A)$$

Here, the electric resistance of the heater 11, the electric resistance of the reference resistance 33, the current applied to the reference resistance, the voltage caused in the heater 11, and the voltage caused in the reference resistance 33 are $R_H$, $R_{ref}$, i, $V_H$, and $V_{ref}$, respectively.

Further, the power output control circuit 34 controls the output of the power supply 31 to realize $V_H = V_{ref}$, and thus the following formula (4A) is established:

$$R_H = R_{ref}/10 \quad (4A)$$

That is, even if the temperature of the heater 11 is changed by change of the environmental temperature and humidity, the power output control circuit 34 controls the output of the power supply 31 such that the electric resistance of the heater 11 becomes 1/N the electric resistance of the reference resistance 33.

As a result, the electric resistance (resistance value) of the reference resistance 33 is controlled to predetermined magnitude, and the temperature of the heater 11 is controlled to the set value (target value), accordingly.

Figure 9:
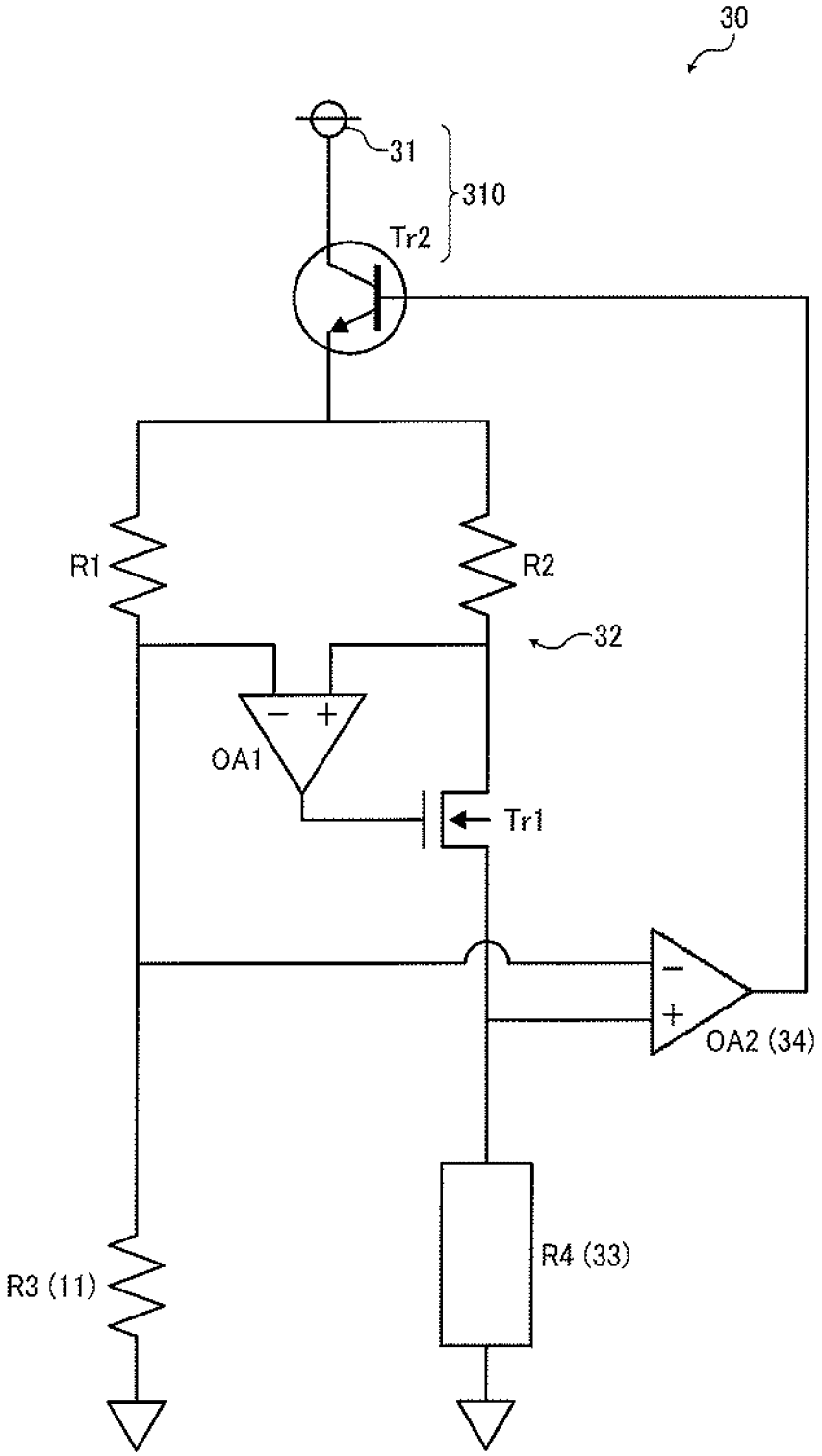
FIG. 9 is a circuit diagram of the temperature control circuit according to the embodiment.

FIG. 9 illustrates a circuit diagram of the temperature control circuit 30. In FIG. 9, the heater 11 is a resistor R3 and the reference resistance 33 is a resistor R4.

In FIG. 9, the current flowing in the resistor R3 is equal to the current flowing in a resistor R1. The current flowing in the resistor R4 is equal to the current flowing in a resistor R2.

The power supply device 310 includes a transistor Tr2 connected to a lower stage of the power supply 31, in addition to the power supply 31. Here, as the transistor Tr2, for example, a bipolar transistor is used. Alternatively, for example, a field effect transistor such as a junction-type field-effect transistor (FET) or metal-oxide semiconductor field-effect transistor (MOSFET) can be used.

The current control circuit 32 is made of the resistor R1, the resistor R2, an operational amplifier OA1, and a transistor Tr1. Here, as the transistor Tr1, for example, a field effect transistor such as a junction-type FET or MOSFET is used. Alternatively, for example, a bipolar transistor may be used.

An output voltage of the operational amplifier OA1 is output such that the voltage caused in the resistor R1 and the voltage caused in the resistor R2 become approximately equal, and is applied to a gate of the transistor Tr1. At this time, a ratio of currents flowing into the resistor R3 and into the resistor R4 can be determined by a ratio of resistance values of the resistor R1 and the resistor R2. That is, the ratio of the currents flowing into the resistor R3 and into the resistor R4 can be controlled to the ratio (to be constant) of the resistance values of the resistor R1 and the resistor R2.

The power output control circuit 34 is made of an operational amplifier OA2.

An output voltage of the operational amplifier OA2 is output such that the voltage caused in the resistor R3 and the voltage caused in the resistor R4 become approximately equal, and is applied to a base of the transistor Tr2 of the power supply device 310. Accordingly, a sum of the currents flowing into the resistor R1 (resistor R3) and into the resistor R2 (resistor R4) is controlled.

In this state, when the resistance value of the resistor R4 is controlled, the current flowing into the resistor R3 is controlled such that the voltage caused in the resistor R3 and the voltage caused in the resistor R4 become approximately equal, and as a result, the resistance value of the resistor R3 is controlled.

The resistor R3 generates heat due to the current, and a resistance value thereof is changed according to the temperature. As a result, the resistance value of the resistor R3 becomes 1/N the resistance value of the resistor R4 (in a case where the ratio of the resistance values of the resistor R1 and the resistor R2 is 1:N).

That is, the current flowing into the resistor R3 is controlled such that the resistance value of the resistor R3 becomes 1/N the resistance value of the resistor R4.

Figure 10:
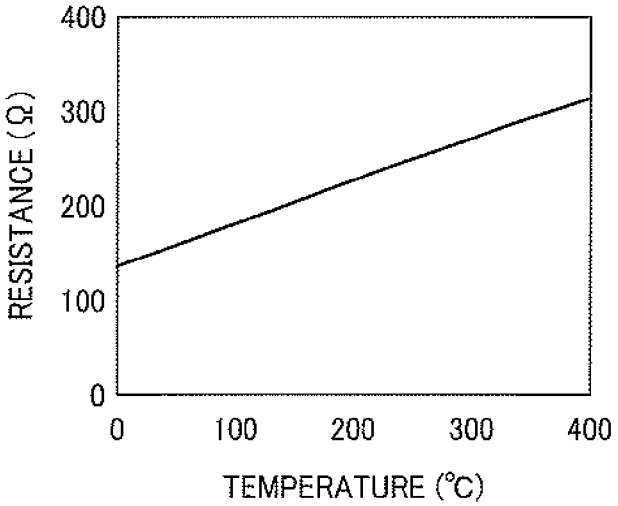
FIG. 10 is a graph illustrating temperature dependency of electric resistance according to the embodiment.

FIG. 10 is a graph illustrating the temperature dependency of the resistance value of the resistor R3. For example, if the temperature of the resistor R3 is intended to become 300° C. when N=10, the resistance value of the resistor R3 may just be 250Ω. To obtain the resistance value, the resistance value of the resistor R4 may just be 2.5 kΩ that is ten times the 250Ω.

As a result, when the resistance value of the reference resistance 33 is controlled, temperature of the heater 11 can be controlled.

Here, first and second configuration examples in which the resistance value of the reference resistance 33 is variable will be described respectively referring to FIGS. 11A and 11B.

Figure 11A:
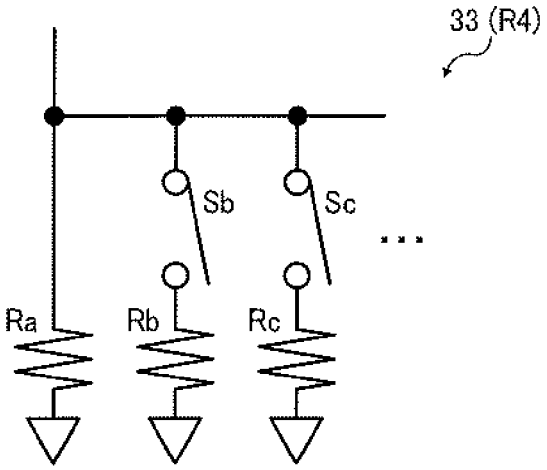
FIGS. 11A and 11B are diagrams respectively illustrating first and second configuration examples of a reference resistance circuit (reference resistance) according to an embodiment.

First, as illustrated in FIG. 11A, the first configuration example is a configuration in which a plurality of resistors can be selectively connected in parallel. To be specific, the reference resistance 33 includes one resistor Ra connected on a constant basis, and a plurality of resistors Rb, Rc, . . . connected with the resistor Ra through a plurality of switches Sb, Sc, . . . , respectively. As the switches, relays or transistors are used, for example.

In this case, the lowest resistance value of the reference resistance 33 is determined by the resistance value of the resistor Ra.

A user can independently switch ON/OFF of the switches Sb, Sc, . . . through an operation unit. Accordingly, the resistance value of the reference resistance 33 can be controlled.

Figure 11B:
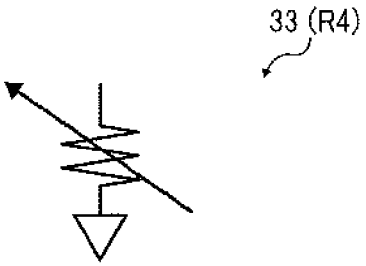

In the second configuration example, as illustrated in FIG. 11B, the reference resistance 33 is variable resistance, and the resistance value can be manually switched through an adjustment dial.

Hereinafter, a support structure of the heater 11 will be described using specific examples.

Figure 12:
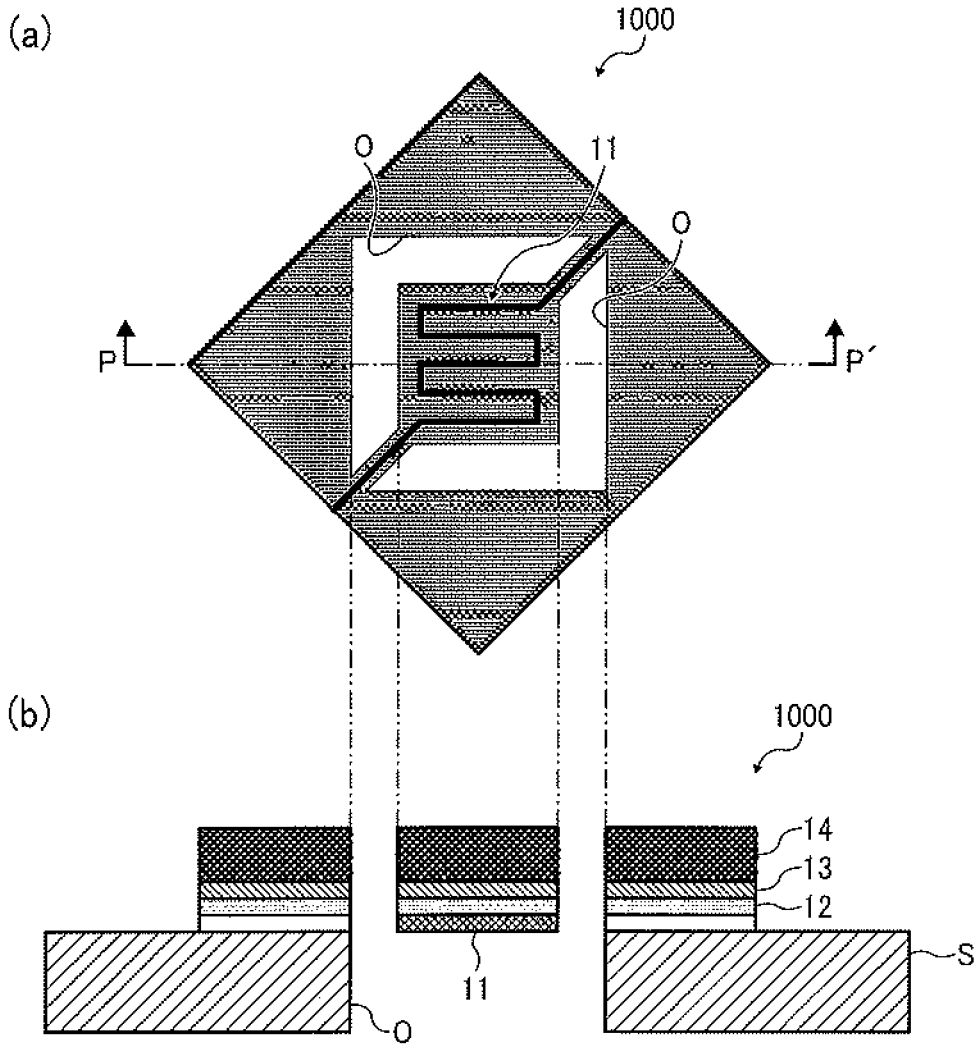
FIG. 12 is diagrams illustrating a heater support structure according to an embodiment.

FIG. 12 is a diagram illustrating a support structure of the heater 11. The upper diagram (a) of FIG. 12 is a diagram of the laminated body 1000 as viewed from the heater 11 side, and the lower diagram (b) of FIG. 12 is a sectional view of the laminated body 1000 (a P-P' sectional view of the upper diagram (a) of FIG. 12).

First, in the heater support structure illustrated in FIG. 12, a pair of opening portions ("O") formed into an L shape with both ends facing each other is formed in the laminated body 1000. A winding portion of the heater 11 is supported in a rectangular or square area in the center between the pair of opening portions O, of the insulating film 12 of the laminated body 1000. Two straight portions (portions continuing into both ends of the winding portion) of the heater 11 are supported in long and narrow areas in both ends between the opening portions O. A peripheral portion of the pair of opening portions O of the laminated body 1000 is supported by a substrate in which a rectangular or square opening corresponding to the pair of opening portions O is formed. Note that, in the upper diagram (a) of FIG. 12, illustration of the substrate is omitted.

That is, in the laminated body 1000, there is a predetermined space between the portion that supports the winding portion of the heater 11 and the peripheral portion thereof. Therefore, the heat capacity can be reduced, compared with a case without the space, and the temperature change of the pyroelectric element film 14 by the heat generation of the heater 11 can be speeded up. That is, the high-speed response can be realized.

According to one embodiment, the ion generator 100 (ion generation device) of the above-described present embodiment includes the heater 11 as a heat-generating body, the counter electrode 20 arranged on the one side of the heater 11, the pyroelectric element film 14 arranged between the heater 11 and the counter electrode 20, the electrode 13 arranged in contact with the pyroelectric element film 14 between the heater 11 and the pyroelectric element film 14 (member made of a pyroelectric element), and the temperature control circuit 30 that controls the temperature of the heater 11.

In this case, the temperature of the pyroelectric element film 14 is changed by the heat generation of the heater 11, and the ions are generated between the pyroelectric element film 14 and the counter electrode 20. At this time, by controlling the temperature of the heater 11, the temperature change amount of the pyroelectric element film 14 can be constantly controlled regardless of the environmental temperature and humidity.

As a result, the ions can be stably generated.

Further, the temperature control circuit 30 controls the temperature of the heater 1 so that the temperature change amount of the pyroelectric element film 14 by the heat generation of the heater 11 becomes a predetermined value.

In this case, the ions can be more stably generated.

Further, the temperature control circuit 30 controls the temperature of the heater 11 to the target value (set temperature) corresponding to the predetermined value.

In this case, the temperature change amount of the pyroelectric element film 14 can be easily set to the predetermined value. Note that it is favorable to acquire a relationship between the target value of the temperature of the beater 11 and the temperature change amount of the pyroelectric element film 14 and make a table of the relationship in advance. Accordingly, the set temperature of the heater 11 with respect to a desired temperature change amount of the pyroelectric element film 14 can be easily found.

The ion generator 100 further includes the insulating film 12 sandwiched by the heater 11 and the electrode 13.

In this case, the heater 11 and the electrode 13 can be reliably insulated. Further, the heater 11, the insulating film 12, the electrode 13, and the pyroelectric element film 14 can be unitized (integrated).

Further, the temperature control circuit 30 includes the power supply device 310 including the power supply 31, and a part of the current from the power supply device 310 is supplied to the heater 11. The temperature control circuit 30 further includes the reference resistance 33 with variable electric resistance, to which the remainder of the current from the power supply device 310 is supplied, the current control circuit 32 that controls the ratio of the current supplied to the heater 11 and the current supplied to the reference resistance 33, and the power output control circuit 34 that controls the output of the power supply device 310 on the basis of the voltage drop in the heater 11 and the voltage drop in the reference resistance 33.

The reference resistance 33 further includes a plurality of resistors. The temperature control circuit 30 further includes a switch that can selectively connect the resistors in parallel. Alternatively, the reference resistance 33 is favorably variable resistance.

Further, the current control circuit 32 controls the ratio of the currents flowing into the heater 11 and to the reference resistance 33 to be approximately constant.

Further, the power output control circuit 34 controls the output of the power supply device 310 such that the voltage drop in the heater 11 and the voltage drop in the reference resistance 33 become approximately the same.

Further, the current control circuit 32 includes the resistor R1 connected to an upper stage of the heater 11, the resistor R2 connected to an upper stage of the reference resistance 33, the operational amplifier OA1 having a first input end connected to a downstream end of the resistor R1 and a second input end connected to a downstream end of the resistor R2, and the transistor Tr1 having a gate connected to an output end of the operational amplifier OA1, a source connected to the downstream end of the resistor R2, and a drain connected to an upstream end of the reference resistance 33.

Further, the power output control circuit 34 includes the operational amplifier OA2 having a first input end connected to the upstream end of the reference resistance 33, and a second input end connected to an upstream end of the heater 11.

Further, the power supply device 310 includes the transistor Tr2 having a base connected to an output end of the operational amplifier OA2, an emitter connected to the power supply 31, and a collector connected to upstream ends of the resistor R1 and the resistor R2. Note that the transistor Tr2 is not essential. That is, the power supply device 310 may be made of only the power supply 31.

According to another embodiment, the ion generator 100 of the present embodiment includes the laminated body in which the heater 11, the insulating film 12, the electrode 13, and the pyroelectric element film 14 are laminated in this order, the counter electrode 20 that faces the pyroelectric element film 14, and the temperature control circuit 30 that controls the temperature of the heater 11.

In this case, the temperature of the pyroelectric element film 14 is changed by the heat generation of the heater 11, and the ions are generated between the pyroelectric element film 14 and the counter electrode 20. At this time, by controlling the temperature of the heater 11, the temperature change amount of the pyroelectric element film 14 can be controlled regardless of the environmental temperature and humidity.

As a result, the ions can be stably generated.

Hereinafter, referring to FIGS. 13 to 17, several modifications of the above embodiment will be described. In the modifications, the same member as that of the embodiment is denoted with the same reference sign, and description of the member is omitted.

Figure 13:
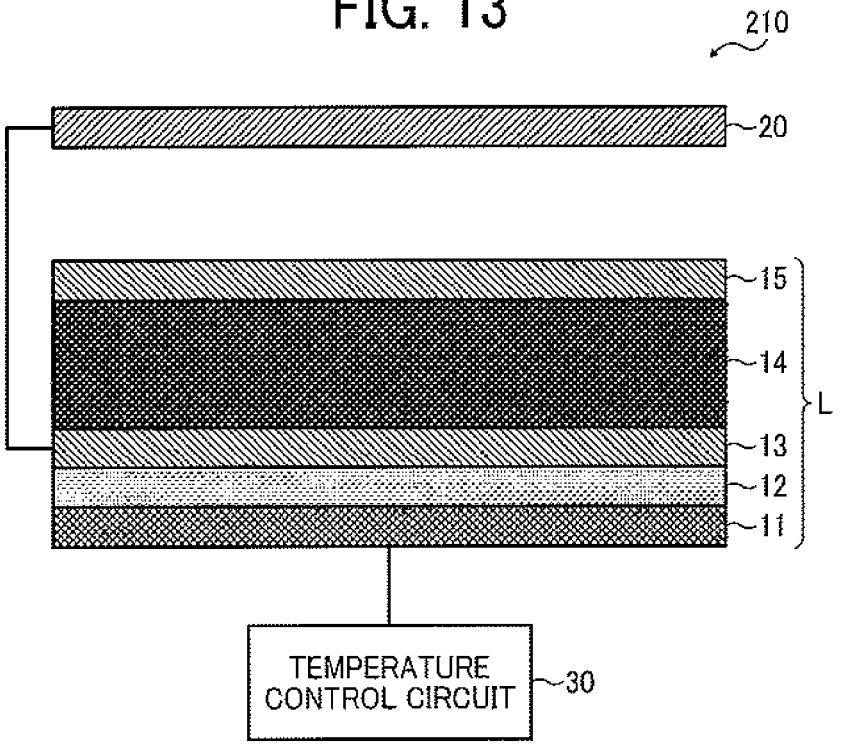
FIG. 13 is a diagram illustrating a schematic configuration of an ion generator of a first modification according to the embodiment.

As illustrated in FIG. 13, an ion generator 210 of a first modification is different from the above-described embodiment in that an electrode 15 arranged in contact with a pyroelectric element film 14 between the pyroelectric element film 14 and a counter electrode 20 is further included, that is, a laminated body further includes the electrode 15 facing the counter electrode 20.

According to the first modification, a surface (plane on the counter electrode 20 side) of the pyroelectric element film 14 is covered with the electrode 15. Therefore, a surface charge of the pyroelectric element film 14 can be efficiently sent to a discharger (a space between the laminated body and the counter electrode 20), and ions can be more stably produced.

Figure 14:
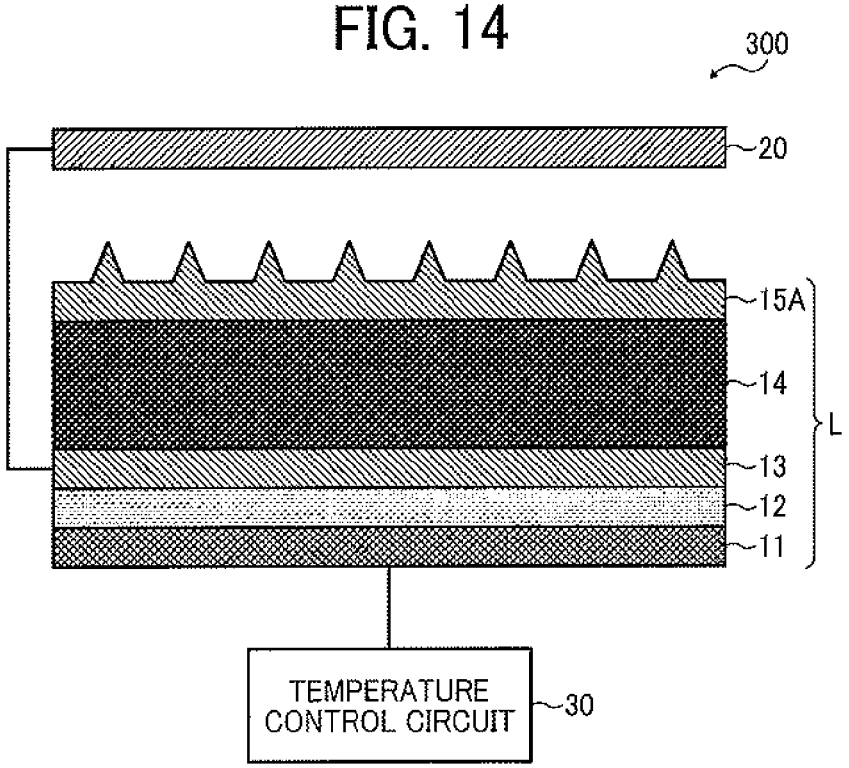
FIG. 14 is a diagram illustrating a schematic configuration of an ion generator of a second modification according to an embodiment.

As illustrated in FIG. 14, an ion generator 300 of a second modification is different from the first modification in that an electrode 15A arranged in contact with a pyroelectric element film 14 between the pyroelectric element film 14 and a counter electrode 20 includes a plurality of protrusions on a plane on a counter electrode 20 side.

According to the second modification, an electric field generated between an electrode 13 and the counter electrode 20 can be concentrated, and a voltage necessary for discharge can be reduced.

Figure 15:
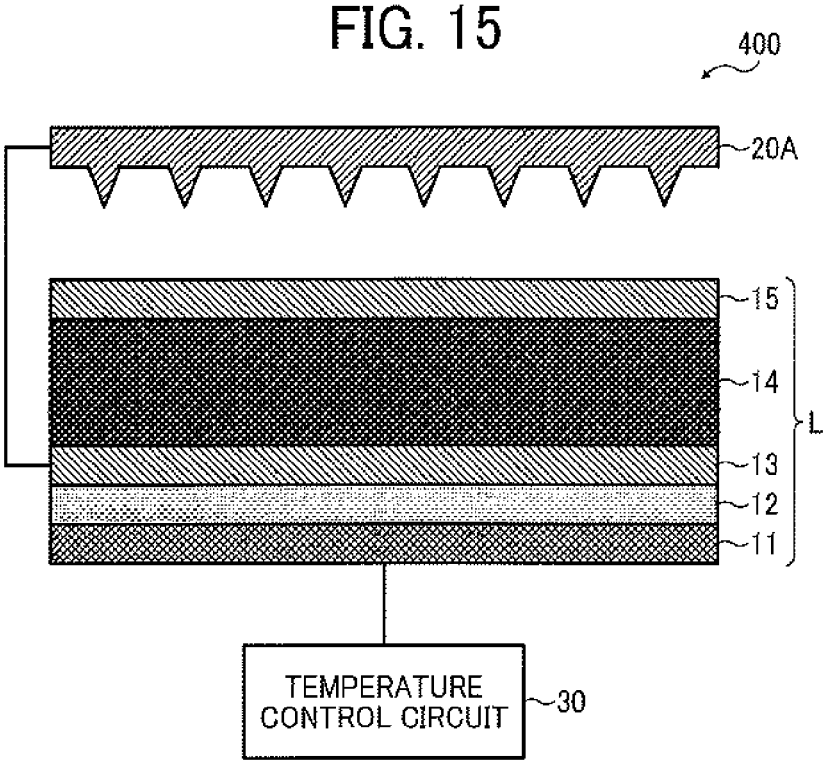
FIG. 15 is a diagram illustrating a schematic configuration of an ion generator of a third modification according to an embodiment.

As illustrated in FIG. 15, an ion generator 400 of a third modification is different from the first modification in that a counter electrode 20 includes a plurality of protrusions on a plane on a laminated body side.

According to the third modification, an electric field generated between an electrode 13 and the counter electrode 20 can be concentrated, and a voltage necessary for discharge can be reduced.

Figure 16:
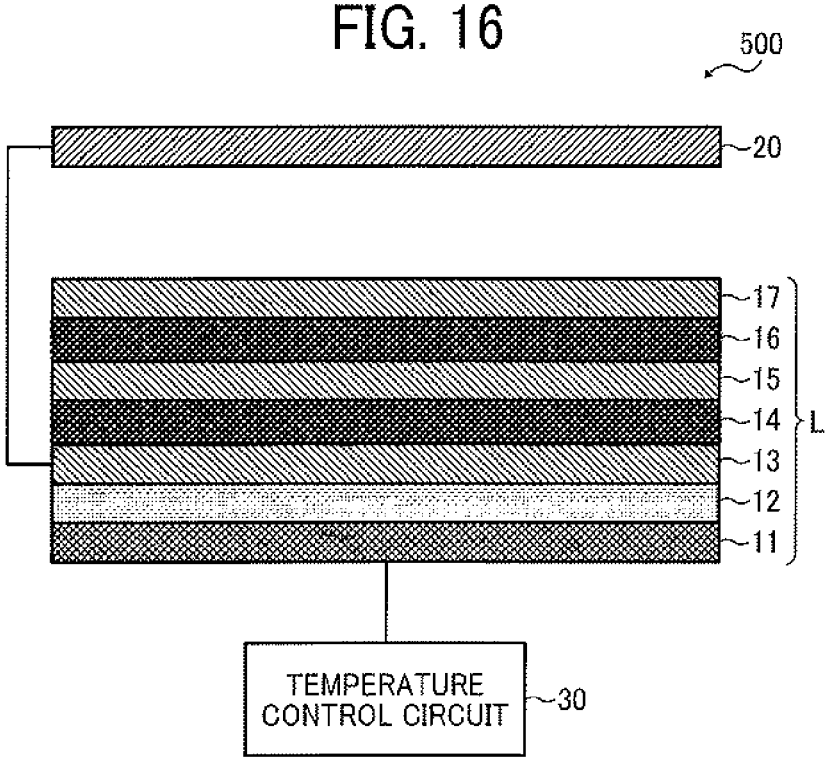
FIG. 16 is a diagram illustrating a schematic configuration of an ion generator of a fourth modification according to an embodiment.

As illustrated in FIG. 16, in an ion generator 500 of a fourth modification, electrodes and pyroelectric element films are alternately arranged between an insulating film 12 and a counter electrode 20. Here, from a heater 11 side to the counter electrode 20 side, an electrode 13, a pyroelectric element film 14, an electrode 15, a pyroelectric element film 16, and an electrode 17 are alternately arranged in this order. That is, the electrode 17 faces the counter electrode 20. Note that the pyroelectric element film 16 may face the counter electrode 20 without providing the electrode 17. The point is that both of the number of the electrodes and the number of the pyroelectric element films being plural is favorable.

According to the fourth embodiment, by using a plurality of thin pyroelectric element films, a generation voltage equivalent to a thick pyroelectric element film can be obtained. That is, the fourth modification is in particular effective when an increase in thickness of the pyroelectric element film is difficult.

Figure 17:
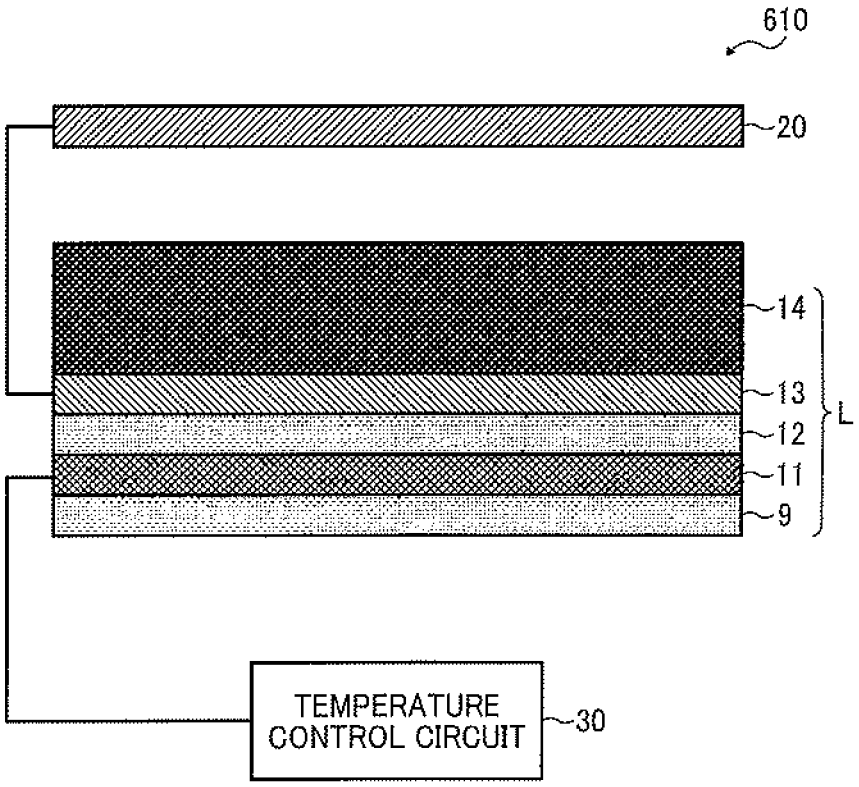
FIG. 17 is a diagram illustrating a schematic configuration of an ion generator of a fifth modification according to an embodiment.

As illustrated in FIG. 17, an ion generator 610 of a fifth modification is different from the above-described embodiment in that an insulating film 9 is provided on a plane of a heater 11 on a side opposite to a counter electrode 20.

According to the fifth modification, physical and chemical deterioration of the heater 11 can be suppressed.

Various modifications of the embodiment can be made in addition to the above-described first to fifth modifications.

Figure 18:
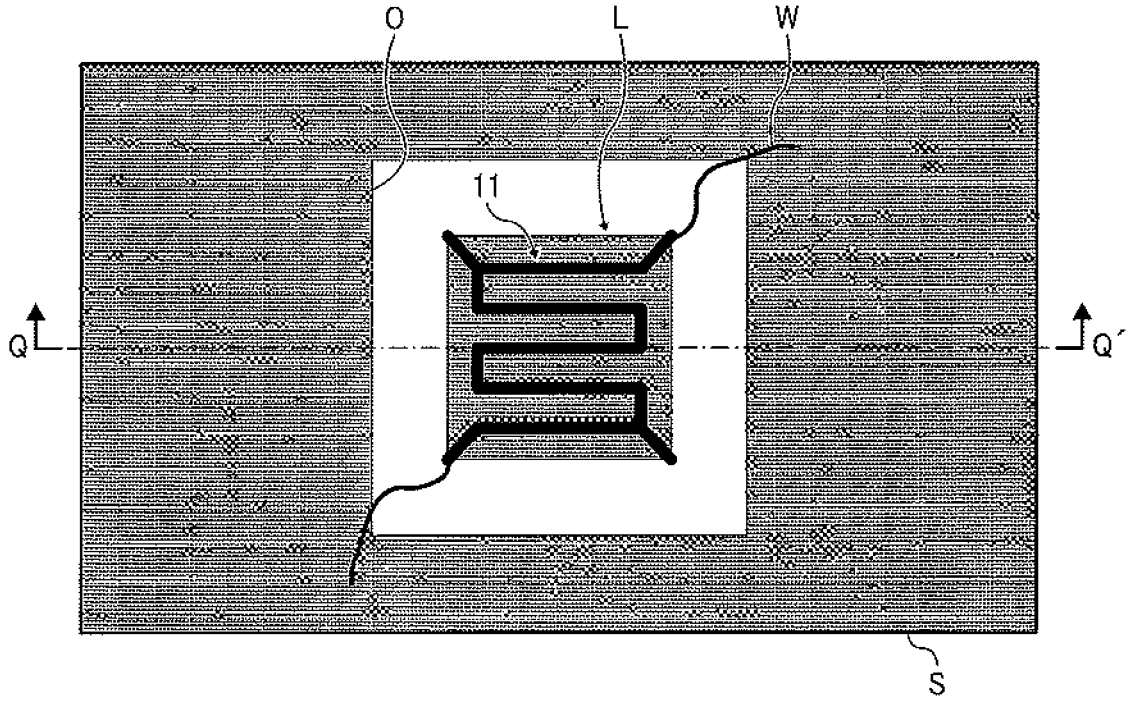
FIG. 18 is a diagram illustrating a support structure of a heater according to an embodiment.
Figure 18:
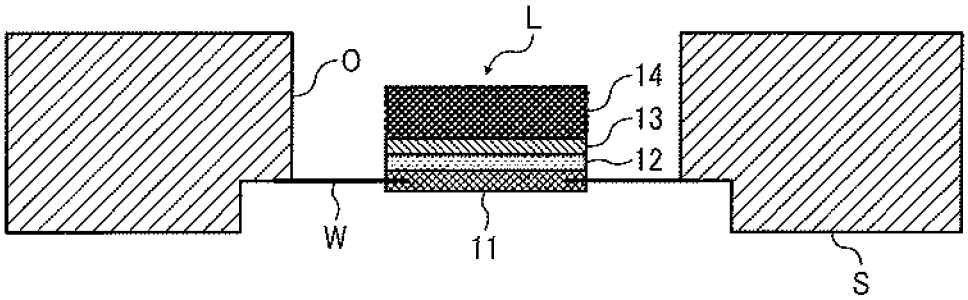

For example, a heater support structure as illustrated in FIG. 18 may be employed according to another embodiment. An upper diagram (a) of FIG. 18 is a diagram of a laminated body 1000 as viewed from a heater 11 side, and a lower diagram (b) of FIG. 18 is a sectional view (a Q-Q' sectional view of the upper diagram of FIG. 18) of the laminated body 1000. In the heater support structure illustrated in FIG. 18, the laminated body 1000 is inserted into an approximately center of a rectangular or square opening "O" formed in a substrate, and is supported in the substrate in a suspended state through a wire connected to one end and the other end of the heater 11.

In this case, there is a space between the laminated body 1000 and the substrate around the laminated body 1000, and reduction of heat capacity can be achieved, compared with a case without the space, and temperature change of the pyroelectric element film 14 by heat generation of the heater 11 can be speeded up. That is, high-speed response can be achieved.

Note that the heater support structure is not limited to the structures illustrated in FIGS. 12 and 18. The point is that a structure in which heat capacity of a unit including the heater 1 and the pyroelectric element film 14 becomes as small as possible is favorable.

Further, in the above-described embodiments including modifications, a heater by a resistive heating method has been used as the heat-generation element. However, an embodiment is not limited thereto, and a heater by an infrared heating method, a heater by a microwave heating method, a heater by an induction heating method, or the like may be used.

Further, in the above-described embodiments including modifications, the insulating film 12 has been arranged between the heater 11 and the electrode 13. However, a space may be provided between the heater 11 and the electrode 13 without providing the insulating film 12. In this case, a gas layer (for example, an air layer) in the space serves an insulating function between the heater 11 and the electrode 13.

Further, in the first to fourth modifications illustrated in FIGS. 14 to 16, electrons may be taken out by applying a voltage to between the counter electrode and the electrode closest to the counter electrode.

Further, in the above-described embodiments including modifications, a piezoelectric element film may be used in place of the pyroelectric element film 14. The piezoelectric element is deformed by heating by the heater 11, and generates a voltage. Therefore, similar effect to the case of using the pyroelectric element film 14 can be expected.

As the piezoelectric element as material for the piezoelectric element film, any material can be used as long as it exhibits piezoelectric effect, and examples include (1) natural crystals such as berlinite (aluminum phosphate) ($AlPO_4$), sucrose, quartz (crystal) ($SiO_2$), rochelle salt (potassium sodium tartrate) ($KNaC_4H_4O_6$), topaz (silicate) ($Al_2SiO_4(F,OH)_2$), and tourmaline group minerals, (2) artificial crystals such as gallium orthophosphate ($GaPO_4$), and langasite ($La_3Ga_5SiO_{14}$), (3) artificial ceramics such as barium titanate ($BaTiO_3$), lead titanate ($PbTiO_3$), lead zirconate titanate (lead zirconate-lead titanate) PZT, potassium niobate ($KNbO_3$), lithium niobate ($LiNbO_3$), lithium tantalate ($LiTaO_3$), sodium tungstate ($Na_XWO_3$), zinc oxide (ZnO, $Zn_2O_3$), $Ba_2NaNb_5O_5$, $Pb_2KNb_5O_{15}$, and lithium tetraborate ($Li_2B_4O_7$), and (4) lead-free ceramics such as sodium potassium niobate ($(K,Na)NbO_3$), bismuth ferrite ($BiFeO_3$), sodium niobate ($NaNbO_3$), bismuth titanate ($Bi_4Ti_3O_{12}$), and bismuth titanate sodium ($Na_{0.5}Bi_{0.5}TiO_3$). Among the above piezoelectric elements, one exhibiting not only the piezoelectric effect but also pyroelectric effect is included.

Further, the material, numerical values, shapes, and the like used in any one of the embodiments including modifications are mere examples and can be appropriately changed without departing from the scope of the present invention.

Figure 19:
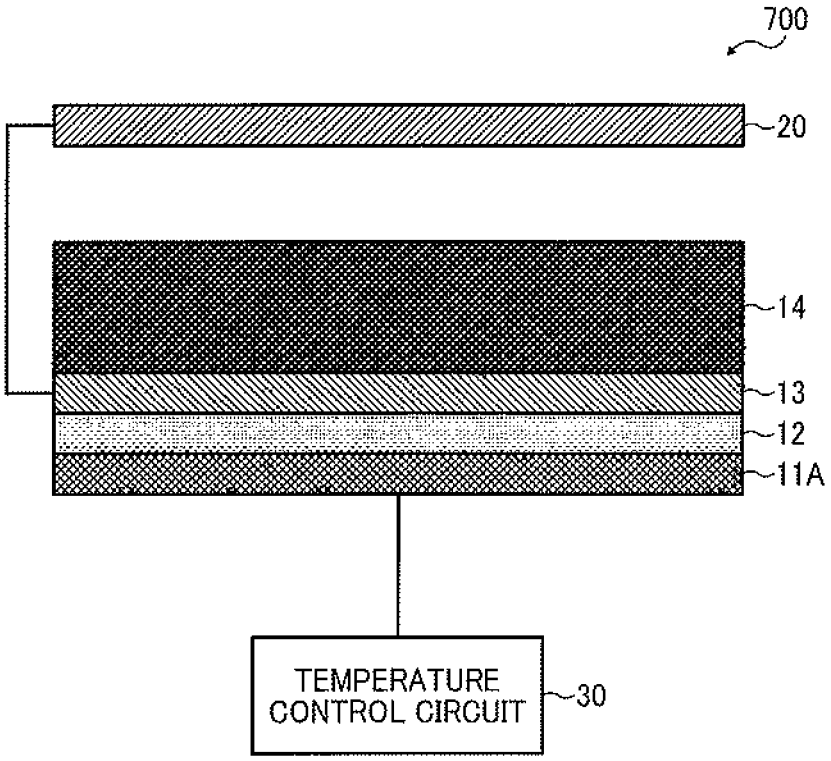
FIG. 19 is a diagram illustrating a schematic configuration of an ion generator of another embodiment.

As illustrated in FIG. 19, an ion generator 700 of another embodiment has a configuration in which the heater 11 in the ion generator 100 of the above-described embodiment is replaced with a Peltier element 11A.

In the ion generator 700, a pyroelectric element film 14 can be heated or cooled by a polarity of a voltage applied to the Peltier element 11A. Further, the voltages caused by pyroelectric effect have opposite polarities at the time of heating and at the time of cooling. Therefore, by using the Peltier element 11A, both of positive ions and negative ions can be caused in one pyroelectric element film 14.

Figure 20:
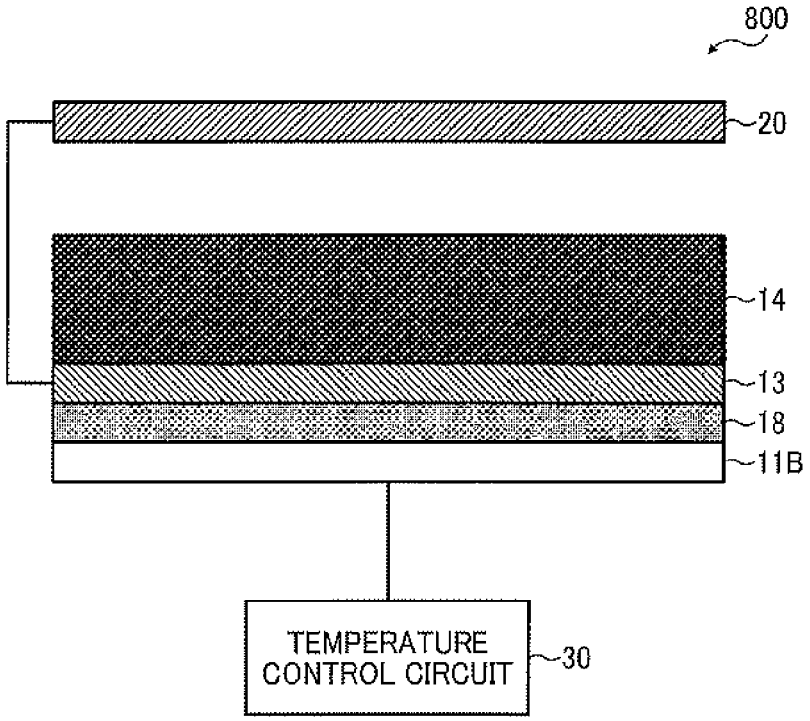
FIG. 20 is a diagram illustrating a schematic configuration of an ion generator of another embodiment.

As illustrated in FIG. 20, an ion generator 800 of another embodiment has a configuration in which the heater 11 and the insulating film 12 in the ion generator 100 of the above-described embodiment are respectively replaced with a light-emitting element 11B and a light-absorbing layer.

In the ion generator 800, by using the light-emitting element 11B in place of the heater 11 as a heat source, heat capacity of the heat source can be eliminated. Therefore, temperature change is performed at a high speed, and voltage response caused by pyroelectric effect becomes fast.

Figure 21:
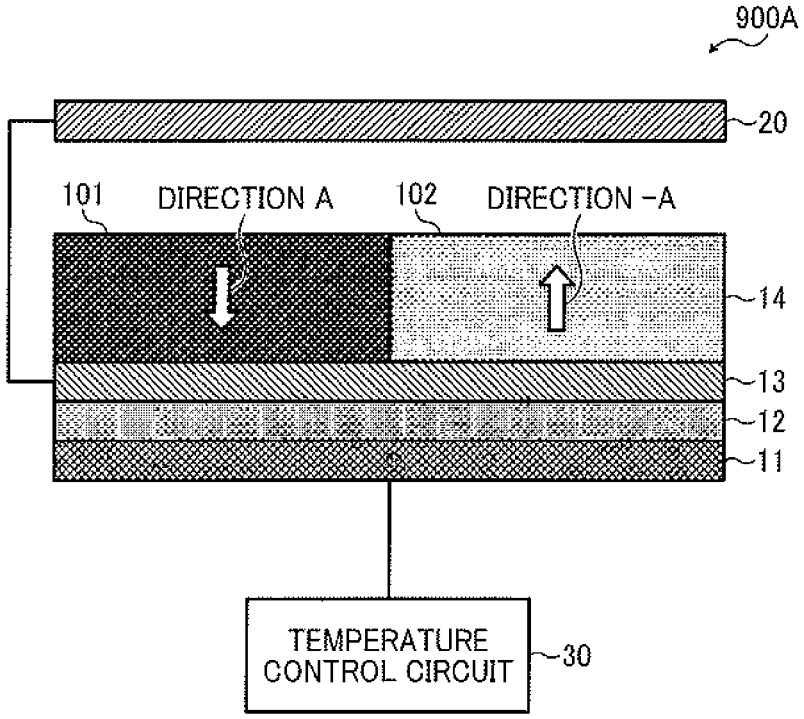
FIG. 21 is a diagram illustrating a schematic configuration of an ion generator of another embodiment.

As illustrated in FIG. 21, an ion generator 900A of another embodiment has a configuration in which the pyroelectric element film 14 in the ion generator 100 of the above-described embodiment has a polarization structure having a partially different polarizing direction (here, a structure including a first portion in which the polarizing direction is an A direction and a second portion in which the polarizing direction is a −A direction).

In the ion generator 900A, voltages caused by pyroelectric effect have opposite polarities in the first portion and in the second portion. Therefore, by having the polarization structure, both of positive ions and negative ions can be caused in one pyroelectric element film 14.

Note that parts of the configurations of the above-described embodiment, the first to fifth modifications, and the second to fourth embodiments can be appropriately combined.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

For example, when the icon generating device includes two electrodes, the electrode farthest from the counter electrode and the counter electrode have an approximately equal potential. In another example, the counter electrode has a plane on a side of the heater, the plane having a plurality of protrusions. The ion generation device may further include other insulator arranged in contact with a plane of the heater, the plane being on a side opposite to a side of the counter electrode.

The invention claimed is:

1. An ion generation device comprising:

a heater;

a counter electrode arranged on one side of the heater;

at least one electric member arranged between the heater and the counter electrode, the electric member being made of a pyroelectric element;

an electrode arranged between the heater and the electric member to be in contact with the electric member; and a temperature control circuit to control a temperature of the heater to maintain the temperature of the heater at a target value such that a temperature change of the electric member caused by heat generated by the heater becomes a predetermined value that corresponds to the target value at which the temperature of the heater is held.

2. The ion generation device according to claim 1, further comprising:

an other electrode arranged between the counter electrode and the electric member to be in contact with the electric member.

3. The ion generation device according to claim 1, wherein the electrode and the electric member are alternately arranged between the heater and the counter electrode, and one of the electrode and an other electrode that is closest to the counter electrode faces the counter electrode.

4. The ion generation device according to claim 1, wherein the electrode and the electric member are alternately arranged between the heater and the counter electrode, and one of the electrode and an other electrode that is closest to the counter electrode has a plane on a side of the counter electrode, the plane having a plurality of protrusions.

5. The ion generation device according to claim 1, wherein the heater, an insulator, the electrode, the electric member made of a pyroelectric element are laminated in a laminated body in this order, and the counter electrode is arranged on a side opposite to the electrode with respect to the electric member.

6. The ion generation device according to claim 1, wherein the heater is a Peltier element.

7. The ion generation device according to claim 1, wherein the heater is a light-emitting element.

8. The ion generation device according to claim 1, wherein the electric member is made of a pyroelectric element having partially different polarizing directions.

9. An ion detection device comprising:

the ion generation device according to claim 1;

an ion filter to sort ions generated at the ion generation device; and a detector to detect the ions sorted in the ion filter.

10. An ion generation device comprising:

a heater;

a counter electrode arranged on one side of the heater;

at least one electric member arranged between the heater and the counter electrode, the electric member being made of a pyroelectric element or a piezoelectric element;

an electrode arranged between the heater and the electric member to be in contact with the electric member; and a temperature control circuit to control a temperature of the heater, wherein the temperature control circuit includes:

a power supply device including a power supply, to supply a first current to the heater;

a reference resistance circuit having a variable electric resistance, and supplied with a second current from the power supply device;

a current control circuit that controls a ratio of the first current supplied to the heater and the second current supplied to the reference resistance circuit; and a power output control circuit that controls an output of the power supply device based on voltage drop in the heater and voltage drop in the reference resistance circuit.

11. The ion generation device according to claim 10, wherein the reference resistance circuit includes a plurality of resistors, and the temperature control circuit further includes a switch that selectively connects the plurality of resistors in parallel.

12. The ion generation device according to claim 10, wherein the reference resistance circuit is variable resistance.

13. The ion generation device according to claim 10, wherein the current control circuit controls the ratio of the current supplied to the heater and the current supplied to the reference resistance circuit to be approximately constant.

14. The ion generation device according to claim 10, wherein the power output control circuit controls the output of the power supply device such that the voltage drop in the heater and the voltage drop in the reference resistance circuit become approximately the same.

15. The ion generation device according to claim 10, wherein the current control circuit includes:

a first resistor connected to an upper stage of the heater;

a second resistor connected to an upper stage of the reference resistance circuit;

a first operational amplifier including a first input end connected to a downstream end of the first resistor and a second input end connected to a downstream end of the second resistor; and a transistor including a gate connected to an output end of the first operational amplifier, a source connected to the downstream end of the second resistor, and a drain connected to an upstream end of the reference resistance circuit.

16. The ion generation device according to claim 15, wherein the power output control circuit further includes:

a second operational amplifier including a first input end connected to the upstream end of the reference resistance circuit, and a second input end connected to an upstream end of the heater.

17. The ion generation device according to claim 16, wherein the power supply device further includes:

a transistor including a base connected to an output end of the second operational amplifier, an emitter connected to the power supply, and a collector connected to upstream ends of the first resistor and second resistor.

18. An ion generation device comprising:

a heater;

a counter electrode arranged on one side of the heater;

at least one electric member arranged between the heater and the counter electrode, the electric member being made of a pyroelectric element or a piezoelectric element;

an electrode arranged between the heater and the electric member to be in contact with the electric member;

a temperature control circuit to control a temperature of the heater; and an insulator sandwiched by the heater and the electrode and in contact with each of the heater and the electrode.

* * * * *